US005445451A

United States Patent [19]

Harmony

[11] Patent Number: 5,445,451

[45] Date of Patent: Aug. 29, 1995

[54] CABINET AND DRAWER LATCH

[76] Inventor: Richard C. Harmony, 10824 Little Lake Rd., Downey, Calif. 90241

[21] Appl. No.: 245,254

[22] Filed: May 17, 1994

[51] Int. Cl.[6] ..... A47B 88/16

[52] U.S. Cl. ..... 312/333; 292/19; 292/DIG. 38

[58] Field of Search ..... 312/333, 330.1; 292/76, 292/87, 19, 81, DIG. 38, DIG. 65

[56] References Cited

U.S. PATENT DOCUMENTS

| | | | |
|---|---|---|---|
| 3,397,001 | 8/1968 | Friedman | 312/333 X |
| 3,971,237 | 7/1976 | Rasmussen | 292/19 |
| 4,378,948 | 4/1983 | Chrones | 292/19 |
| 4,416,477 | 11/1983 | Bialobrzeski et al. | 292/DIG. 38 X |
| 4,714,284 | 12/1987 | Varlet | 292/DIG. 38 X |

OTHER PUBLICATIONS

"Baby Guards Safety Latches", Playskool Baby, Inc., Northvale, N.J. 1991.

"Lifetime Guaranteed Cabinet Latches No. 1409-Z", Sanitoy, Inc., Fitchburg, Mass. 1991.

"Safety 1st-Child Proof your Cabinets, No. 11617R", Safety 1st Inc., Chestnut Hill, Mass. 1986.

"Gerber Drawer Latches", Gerber Products Company, Fremont, Mich. 1992.

*Primary Examiner*—Kenneth J. Dorner
*Assistant Examiner*—Robert Sandy
*Attorney, Agent, or Firm*—Cahill, Sutton & Thomas

[57] ABSTRACT

A latch secured to a cabinet door includes dual flexible prongs having bulbous ends for engaging an anchor mounted within a cabinet. Upon closing of the cabinet door, the prongs flex and the bulbous ends snap into depressions within the anchor to restrict opening of the cabinet door to a limited extent. Upon initial opening of the cabinet door, both prongs must be manually simultaneously flexed to disengage the bulbous ends from the anchor and permit full opening of the cabinet door.

10 Claims, 2 Drawing Sheets

CABINET AND DRAWER LATCH

BACKGROUND OF THE INVENTION

1. Field of the Invention

The present invention relates to door latches and, more particularly, latches for restricting the full opening of a cabinet door or drawer to a limited extent.

2. Description of Related Art

The curiosity of toddlers and young children is unbounded. Such curiosity causes them to open cabinet doors and drawers within reach. Often, the corresponding cabinets and drawers contain articles or chemicals which may be or will be injurious if ingested or otherwise have a likelihood of causing injury. To prevent access by toddlers and young children to cabinets and drawers, various locking and latching mechanisms have been used.

The use of key operated or combination operated locks on cabinets and drawers are very effective guards against unwanted access by toddlers and young children. However, such locking mechanisms are inconvenient and irritating to adults who wish periodic or regular access and therefore such mechanisms are seldom used. To avoid the use of locking mechanisms, various latches have been developed and some of which are presently commercially available. These latches generally include a single prong attached to a cabinet door or drawer front. Upon closing of the cabinet door or drawer, a hook or the like at the distal end of the prong engages a depression or other receiver formed in an anchor mounted within the cabinet or the top of the drawer compartment. These latches permit limited opening of the cabinet door or drawer to provide manual access to the prong. By depressing the prong, it becomes disengaged from the anchor to permit the cabinet door or drawer to be fully opened. Young children, or even toddlers, can quickly discover that it is possible to open the cabinet door or drawer by pushing on such a prong. Thus, the latch becomes ineffective to serve the purpose intended and the child is at risk.

SUMMARY OF THE INVENTION

A latch for preventing access to a cabinet or drawer by a young child includes a pair of prongs extending from a cabinet door or drawer front. The pair of prongs are displaced from one another to a degree sufficient to preclude the span of the child's hand from flexing both prongs simultaneously. Each of the prongs includes a bulbous end for lockingly engaging a depression within an anchor mounted in the cabinet or the top of the drawer compartment. The length of the prongs, in combination with the location of the anchor, permits limited opening of the cabinet door on drawer to the extent necessary to permit manual access to both prongs. Release of the latch requires that both prongs be flexed simultaneously to bring about disengagement of the bulbous ends from the anchor. As a small child's hand is too small to reach both prongs to flex them simultaneously, the latch remains effective even if both of the prongs are flexed serially.

It is therefore a primary object of the present invention to provide a latch for cabinet doors and drawers.

Another object of the present invention is to provide a childproof latch which requires manipulation incapable of being performed by a young child's hand.

Still another object of the present invention is to provide a latch having a pair of laterally displaced flexible prongs for engaging an anchor.

Yet another object of the present invention is to provide a latch having a pair of anchor engaging prongs which require simultaneous flexing to obtain disengagement from the anchor.

A further object of the present invention is to provide an easily mountable double prong childproof latch for cabinet doors and drawers.

A still further object of the present invention is to provide an inexpensive childproof latch.

A yet further object of the present invention is to provide a low parts count childproof latch for cabinet doors and drawers.

These and other objects of the present invention will become apparent to those skilled in the art as the description proceeds.

BRIEF DESCRIPTION OF THE DRAWINGS

The present invention will be described with greater specificity and clarity with reference to the following drawings, in which:

FIG. 5 is a cross-sectional view taken along lines 5—5 as shown in FIG. 1;

DESCRIPTION OF THE PREFERRED EMBODIMENTS

Figures 1, 2, 3, 4, 5:
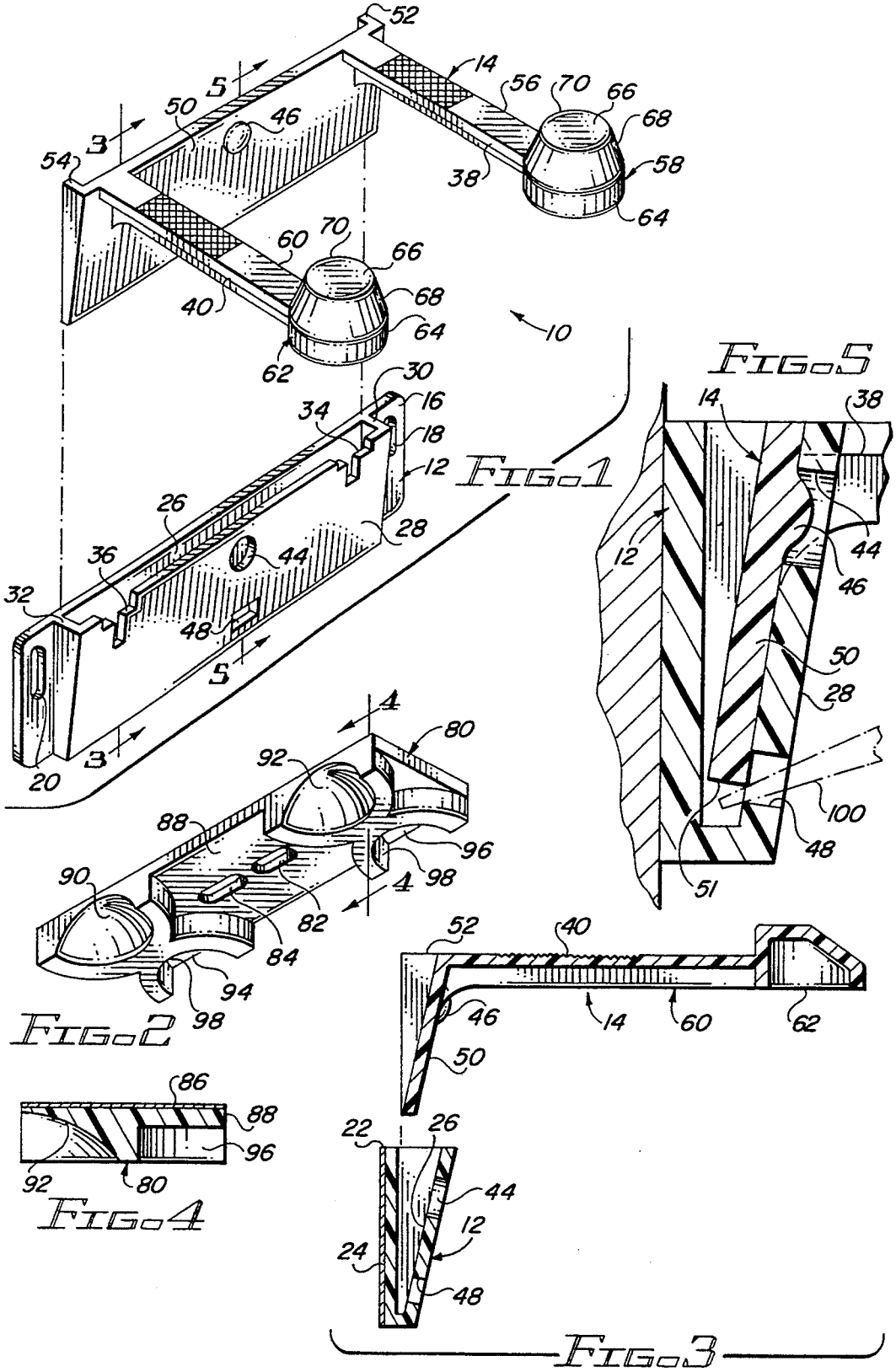
FIG. 1 is an isometric exploded view of the dual prong latch.
FIG. 2 is an isometric view of an anchor to be engaged by the prongs of the latch.
FIG. 3 is a cross-sectional view taken along lines 3—3, as shown in FIG. 1.
FIG. 5 is a cross-sectional view taken along lines 4—4, as shown in FIG. 2.

Referring to FIG. 1, there is illustrated a latch 10 formed of a bracket assembly 12 and a prong assembly 14. The bracket assembly includes a back plate 16 for attachment to a cabinet door or the inside surface of a drawer front by screws or the like extending through apertures 18,20. Alternatively, a doublesided layer 22 of adhesive (as shown in FIG. 3) may be secured to face 24 of the bracket assembly to adhere the bracket assembly to the cabinet door or drawer front. A pocket 26 is formed within bracket assembly 12 between back plate 16, angled front plate 28 and side walls 30,32. Plate 28 includes cut outs 34,36 for receiving arms 38,40 of prong assembly 14. An aperture 44 is disposed in plate 28 to receive button 46 of prong assembly 14. An access aperture 48 is also disposed in the front plate and its function will be described below.

Prong assembly 14 includes a base 50 having tapered side walls 52,54. The base and the side walls are insertable within pocket 26 of bracket assembly 12 and retained therein by button 46 engaging aperture 44 in the manner of a detent. Accommodation for arms 38 and 40 is provided by cut outs 34,36. A prong 56 extends from base 50 and includes a bulbous end 58. Similarly, prong 60 extends from base 50 and includes a bulbous end 62. Each of bulbous ends 58,60 may be formed with a circular base 64, a circular top 66 axially offset from the base and interconnected by a non-symmetrically tapered surface 68 defining an upwardly extending surface section 70 at the rear edge and perpendicular to the longitudinal axis of the respective prong.

Referring to FIG. 2, there is illustrated an anchor assembly 80 mountable upon an interior wall or ceiling of a cabinet or the inside top of a drawer compartment by screws or the like extending penetrably through apertures 82,84. Alternatively, a layer 86 of adhesive (as illustrated in FIG. 4) may be used to mount the anchor assembly. Anchor assembly 80 includes a plate 88 supporting a ramp 90 for guiding bulbous end 58 of prong 56 to cause deflection of arm 38. A further ramp 92 is formed upon plate 88 to guide bulbous end 62 of prong 60 and cause deflection of arm 40. A receiver 94 is located proximate ramp 90 to receive and engage a section (such as section 70) of tapered surface 68 of bulbous end 58 adjacent arm 38. A further receiver 96 proximate ramp 92 is configured to engage a section (such as section 70) of tapered surface 68 of bulbous end 62 adjacent arm.

As illustrated in FIG. 3, the lateral cross-section of pocket 26 within bracket assembly 12 is configured to receive base 50 and side walls 52,54 of prong assembly 14. Upon such engagement, base 50 will be adjacent the inside surface of plate 28 and button 46 will engage aperture 44 to lock prong assembly 14 with bracket assembly 12 in the manner of a detent.

After insertion of base 50 into pocket 26, as illustrated in FIG. 5, disengagement of the prong assembly from the bracket assembly may be easily accomplished. A narrow tool 100, such as the blade of a screwdriver, is inserted through aperture 48 adjacent lower edge 51 of plate 50. By prying the tip of tool 100 upwardly, button 46 will be forced out of engagement with aperture 44. Upon such disengagement, prong assembly 14 may be readily withdrawn from pocket 26 of bracket assembly 12.

Referring jointly to FIGS. 6A–6F, closure and latching of a drawer will be described; It is to be understood that a cabinet door can be similarly closed and latched. Bracket assembly 12 is secured to inside face 110 of a drawer front 112 by screws 114, or the like penetrably engaging apertures 18,20; As noted above, the bracket assembly may be secured in place by a layer of adhesive. Prong assembly 14 is disposed within pocket 26 of the bracket assembly and retained therein by engagement of button 46 with aperture 44. Anchor assembly 80 is attached to surface 116 of sheet 118 defining the top of the drawer compartment by screws 120 or the like penetrably inserted through apertures 82,84; A layer of adhesive may also be used, as discussed above.

Figure 6A:
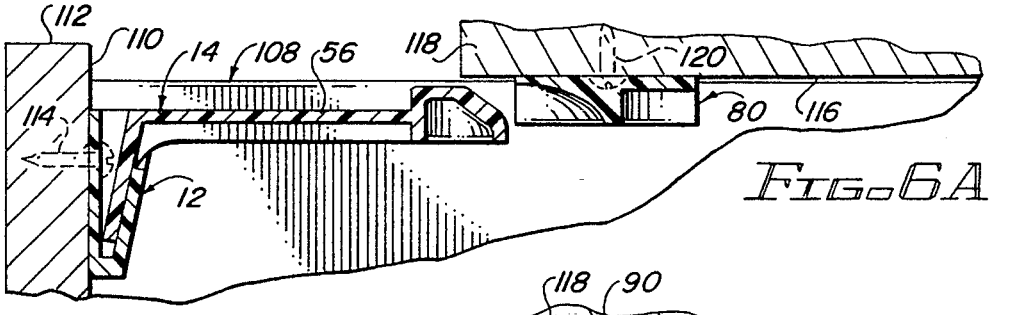
FIGS. 6A–6F illustrate the steps for locking the latch.
Figure 6B:
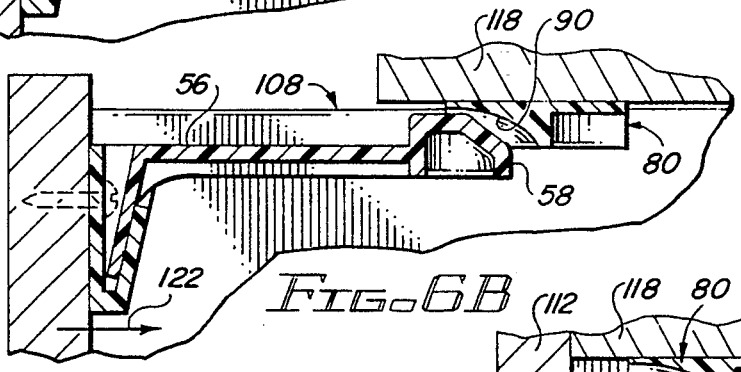
Figure 6C:
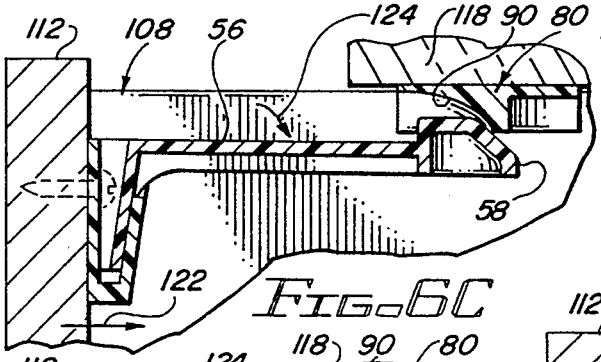
Figure 6F:
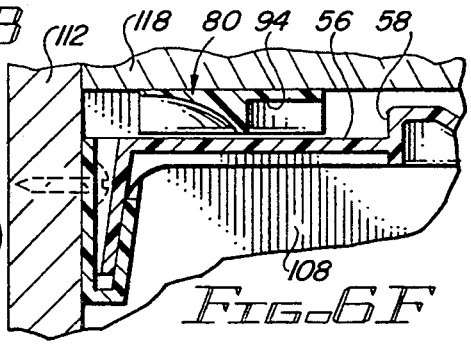
Figure 6D:
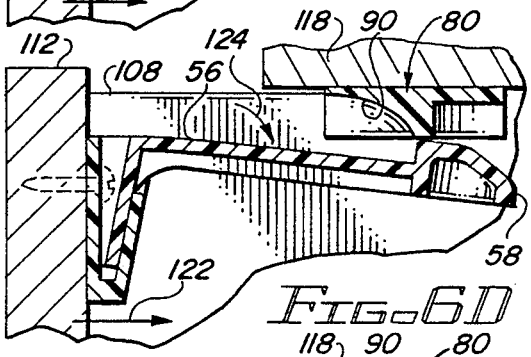
Figure 7A:
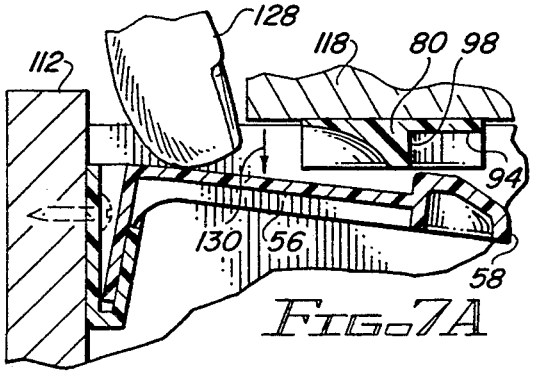
FIGS. 7A and 7B illustrate the steps for releasing the latch.

While only prong 56 and the related parts of anchor assembly 80 will be described below, it is to be understood that prong 60 operates identically and simultaneously with prong 56 upon closure of drawer 108. Upon closure of the drawer, as depicted by arrow 122 shown in FIG. 6B, bulbous end 58 will engage ramp 90. Such engagement will cause prong 56 to be deflected downwardly, as depicted by arrow 124 in FIG. 6C with commensurate downward movement of bulbous end 58. Upon further closure of drawer 108, further deflection of prong 56 will occur until bulbous end 58 is past ramp 90,.as depicted in FIG. 6D. With yet further closing movement of drawer 108, bulbous end 58 will become coincident with receiver 94 of anchor assembly 80. Since the anchor assembly no longer is forcing bulbous end 58 downwardly, prong 56 will flex upwardly, depicted by arrow 126 in FIG. 6D. Such upward flexing of prong 56 and commensurate movement of bulbous end 58 will locate the bulbous end within receiver 94. Section 70 of the bulbous end, being essentially perpendicular to the axis of prong 56, will be adjacent a correspondingly configured surface 98 of receiver 94. It may be noted from FIG. 6E that drawer front 112 is not adjacent the front edge of sheet 118 and the space therebetween renders the drawer slightly open. Moreover, manual access to prong 56 (and prong 60) is possible through this space. Upon complete closure of drawer 108, as depicted in FIG. 6F, drawer face 112 is adjacent the front edge of sheet 118. Furthermore, bulbous end 58 of prong 56 has been located past anchor assembly 80 and out from within receiver 94.

Figure 6E:
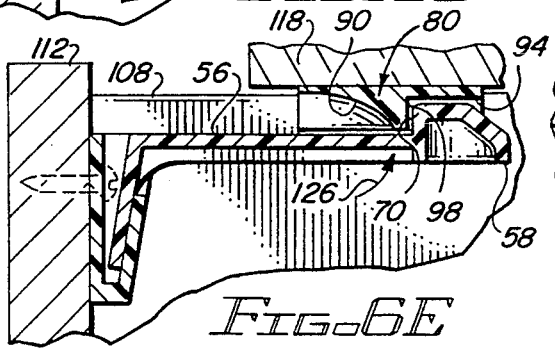
Figure 7B:
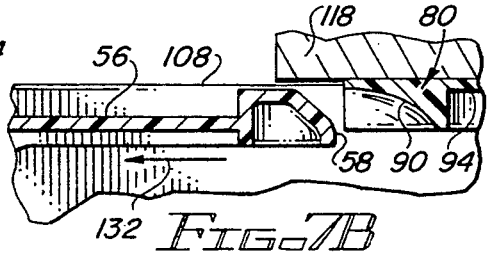

To open drawer 108, it is pulled in the normal manner and will open to the extent illustrated in FIG. 6E until bulbous end 58 of prong 56 (and bulbous end 62 of prong 60) comes into engagement with receiver 94 (and with receiver 96). Further opening of the drawer is precluded by the interference between sections 70 of the bulbous ends 58,62 and corresponding surfaces 98 of receivers 94,96. Thus, an impediment is presented to complete opening of the drawer and access to the contents therein. To permit full opening of the drawer, one can place one's finger, such as finger 128, adjacent prong 56 to depress the prong, as depicted by arrow 130 and a further finger has to simultaneously depress prong 60. The resulting flexing of prongs 56,60 will cause bulbous ends 56,62 to be moved downwardly out of engagement with receivers 94,96. The resulting prong movements release the prongs from anchor assembly 80. Thereafter, drawer 108 may be fully opened, as depicted by arrow 132 in FIG. 7B.

To prevent a young child from opening the drawer in the manner described above, prongs 56,60 are spaced apart to an extent greater than the span of the fingers of the child's hand. Thus, the child cannot use one hand to depress both prongs simultaneously. For an adult, however, the act of depressing both prongs simultaneously is easily accomplished by using two different fingers of the same hand. While it is possible for a child to use both hands to depress both prongs simultaneously, this level of manipulative skill and hand/eye coordination is generally absent in children of the age for which the dual pronged latch was intended to protect.

While the above discussion relating to the operative functions illustrated in FIGS. 6A–6F and 7A–7B was made with respect to the environment presented by a drawer, the operation is identical in an environment represented by a cabinet door and the cabinet enclosure. That is, bracket assembly 12 would be mounted upon the inside surface of the cabinet door and anchor assembly 80 would be mounted on the inside top surface of the cabinet enclosure or against a sidewall of the cabinet opposite to the hinge line of the cabinet door. After closure of the cabinet door at least to the extent depicted in FIG. 6B, reopening of the cabinet door without simultaneous flexing of prongs 56,60 is precluded.

The position of the anchor assembly is variable and commensurate with the type and nature of structure adjacent the place of mounting. It must, however, be mounted sufficiently close to the drawer or cabinet opening to permit manual access to both prongs sufficient to flex them downwardly.

While bulbous ends for the terminal ends of the prongs have been depicted, otherwise configured ends, such as hooks, tangs, studs, spheres, etc. could be used. Necessarily, the receivers of the anchor assembly would have to be commensurately configured to capture such terminal ends upon upward flexing of the prongs when in the position shown in FIG. 6E.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

I claim:

1. A latch for limiting movement of one element with respect to another element, said latch comprising in combination:

a) a prong assembly secured to one of the elements, said prong assembly including a pair of flexible spaced apart prongs and a bracket supporting each prong of said pair of prongs each prong of said pair of prongs including a terminal end;

b) an anchor assembly secured to another of the elements for capturing each terminal end of said pair of prongs, said anchor assembly including a pair of receivers to receive and capture said terminal ends to limit movement of the one element with respect to the other element; and c) corresponding surfaces disposed upon each respective receiver of said pair of receivers for retaining said terminal ends with said anchor assembly upon capture of said terminal ends by said pair of receivers and for releasing said terminal ends from said pair of receivers upon simultaneous flexing of said pair of prongs and disengaging said pair of prongs from said anchor assembly to permit movement of the one element with respect to the other element.

2. A latch as set forth in claim 1, including a detent for retaining said prong assembly supported by said bracket assembly.

3. A latch as set forth in claim 1, wherein each of said terminal ends includes a tapered surface and wherein said anchor assembly includes a pair of ramps for guiding the respective one of said terminal ends into the respective one of said receivers.

4. A latch as set forth in claim 1, wherein each of said terminal ends includes a bulbous end locatable partially within the respective receiver of said pair of receivers in engagement with said corresponding surfaces to prevent disengagement between said bulbous ends and said receivers without flexing of each prong of said pair of prongs.

5. A cabinet latch, said latch comprising in combination:

a) a dual prong assembly including a pair of prongs, each prong of said pair of prongs extending from a bracket, said bracket being attachable to a door of a cabinet, each prong of said pair of prongs including a terminal end;

b) an anchor assembly secured within the cabinet for engaging and retaining said terminal ends upon partial closure of the cabinet door;

c) said anchor assembly including a ramp for guiding said terminal ends and for causing flexing of said pair of prongs upon initial engagement of said pair of prongs with said ramp of said anchor assembly; and d) said anchor assembly including a pair of receivers for receiving said terminal ends and simultaneously permitting un-flexing of said pair of prongs upon further closure of the cabinet door by engagement of said terminal ends with said receivers to capture said terminal ends to prevent complete opening of the cabinet door without simultaneous flexing of said dual prongs to release said terminal ends from said anchor assembly.

6. The latch as set forth in claim 5 wherein said bracket includes a pocket for receiving a part of said dual prong assembly.

7. The latch as set forth in claim 6 including a detent for retaining said dual prong assembly within said pocket.

8. A drawer latch for releasably securing a drawer front of a drawer with a drawer compartment, said latch comprising in combination:

a) a dual prong assembly securable to the inside face of the drawer front of the drawer, said dual prong assembly including a pair of separate independent prongs and a bracket for supporting each prong of said pair of prongs extending from said bracket, each prong of said dual prong assembly including a terminal end displaced from said bracket;

b) an anchor assembly securable to a surface of a sheet defining the drawer compartment for engaging and retaining each of said terminal ends upon partial closure of the drawer;

c) a ramp of said anchor assembly for guiding each of said terminal ends and causing flexing of said dual prongs upon initial engagement of each prong of said pair of prongs with said anchor assembly; and d) a receiver of said anchor assembly for receiving and retaining each of said terminal ends and for accommodating un-flexing of said pair of prongs to result in capture of said terminal ends within said receivers, said pair of prongs being accessible to a user upon partial opening of the drawer to permit simultaneous flexing of said pair of prongs to disengage each of said terminal ends from said receivers and accommodate opening the drawer.

9. A drawer latch as set forth in claim 8, wherein said bracket assembly includes a pocket for receiving a part of said dual prong assembly.

10. A drawer latch as set forth in claim 9, including a detent for retaining said dual prong assembly within said pocket.

* * * * *